US006748092B1

(12) United States Patent
Baekgaard

(10) Patent No.: US 6,748,092 B1
(45) Date of Patent: Jun. 8, 2004

(54) HEARING AID WITH IMPROVED PERCENTILE ESTIMATOR

(75) Inventor: Lars Baekgaard, Farum (DK)

(73) Assignee: Widex A/S, Vaerloese (DK)

( * ) Notice: Subject to any disclaimer, the term of this patent is extended or adjusted under 35 U.S.C. 154(b) by 0 days.

(21) Appl. No.: 09/194,639

(22) PCT Filed: Dec. 14, 1996

(86) PCT No.: PCT/EP96/05623

§ 371 (c)(1),
(2), (4) Date: Dec. 1, 1998

(87) PCT Pub. No.: WO98/27787

PCT Pub. Date: Jun. 25, 1998

(51) Int. Cl.[7] ..... H04R 25/00

(52) U.S. Cl. ..... 381/313; 381/321; 381/328; 455/173.1; 455/200.1; 455/219; 455/234.1; 455/241.1

(58) Field of Search ..... 381/312, 314, 381/320 Q, 321, 317 Q, 313, 316, 317, 318, 320; 455/173, 200.1, 219, 232.1, 234.1, 240.1, 241.1, 250.1, 251.1

(56) References Cited

U.S. PATENT DOCUMENTS 4,204,260 A 5/1980 Nysen
4,823,795 A 4/1989 van den Honert
5,027,410 A 6/1991 Williamson et al.
5,687,241 A 11/1997 Ludvigsen

*Primary Examiner*—Curtis Kuntz
*Assistant Examiner*—Dionne N. Harvey
(74) *Attorney, Agent, or Firm*—Sughrue Mion, PLLC

(57) ABSTRACT

The invention relates to a hearing aid, preferably a programmable hearing aid, having at least one microphone (1), at least one signal processor with at least one channel, an output amplifier (9) and an output transducer (10), at least one of the channels containing a signal processing circuit (4) with at least one percentile estimator (6) for the continuous determination or calculation of at least one percentile value of the input signal from a continuous analysis and evaluation of the frequency and/or amplitude distribution of the input signal, whereby the percentile value(s) serve either directly or indirectly as control signals for controlling the gain and/or the frequency response of the electronic processing circuit, the percentile estimator (6) consisting essentially of a comparator stage (12) with two inputs and two outputs, the first input being directly or indirectly connected to the input of the hearing aid, its two outputs controlling a first control stage (13) the output signals of which control a first integrator (14), the output of which, directly or indirectly, conveys a control signal to the signal processing circuit (5) and the second input of the comparator stage. The invention comprises at least a second control stage (16) connected to the first control stage (13), and at least one additional integrator (17) controlled by the second control stage (16), the output of which is connected to a further input of the second control stage (16) and to a multiplier stage (15) interconnected between the first control stage (13) and the first integrator (14).

14 Claims, 5 Drawing Sheets

HEARING AID WITH IMPROVED PERCENTILE ESTIMATOR

BACKGROUND OF THE INVENTION

The invention relates to a hearing aid, preferably to a programmable hearing aid having at least one microphone, at least one signal processor with at least one channel, an output amplifier and an output transducer, at least one of the channels containing a signal processing circuit with at least one percentile estimator for the continuous determination or calculation of at least one percentile value of the input signal from a continuous analysis and evaluation of the frequency and/or amplitude distribution of the input signal, whereby the percentile value(s) serve either directly or indirectly as control signals for controlling the gain and/or the frequency response of the electronic processing circuit, the percentile estimator consisting essentially of a comparator stage with two inputs and two outputs, the first input being directly or indirectly connected to the input of the hearing aid, its two outputs controlling a first control stage the output signals of which control a first integrator, the output of which, directly or indirectly, conveys a control signal to the signal processing circuit and the second input of the comparator stage.

Percentile estimators which may also be used in hearing aids, are known in principle from U.S. Pat. No. 4,204,260.

Clinical tests have shown, that the use of correctly fitted hearing aids, i.e. hearing aids with constant gain, independent of signal-levels, in noisy as well as quiet surroundings are superior to hearing aids with an automatic gain control, with respect to speech comprehension. However, while linear hearing aids require the user to adjust the volume control dependent on the actual listening environment, hearing aids with automatic gain control adapt themselves to the environment and thereby clearly improve the ease-of-use.

Based on the clinical tests mentioned above, the percentile estimators have to work very slowly to achieve an almost constant gain for speech signals. This works very well if one slays in an environment where the level of sound is not varying too much, but the long response times of the system will in some cases not adapt fast enough to changes in environment, resulting in phrases not being heard.

A common problem is the situation where the user of the hearing aid is yelling a message to a distant person. This will increase the percentile estimate and hence reduce the gain in the hearing aid. Since the percentile estimator works slowly, the gain stays reduced for a while, and the hearing aid user will not be able to hear the distant person answering, because the resulting output of the hearing aid will be very low, perhaps even below the user's hearing threshold level.

On the other hand one could let the percentile estimators work fast, which obviously will make the system adapt faster to changes in environment, but the gain con then not be considered constant for the speech signals. The fast going adjustment of the system will cause "pumping"-effects, which can be very annoying for the user, especially in noisy surroundings, and may result in loss of speech comprehension.

In an automatic gain control system for hearing aids, percentile estimators operating on the present signal in one or more channels may be used for controlling the gain of the electronic signal processors. Such a system is f.i. disclosed in WO 95/15668 (corresponding to U.S. Pat. No. 5,687,241) of applicant.

SUMMARY OF THE INVENTION

It is an object of the present invention to create an improved percentile estimator, particularly for use in hearing aids of the kind referred to above, which makes it possible for the hearing aid to adapt fast to changes in the environment, while maintaining a slow response when operating on continuous signals, e.g. speech signals in a steady environment.

This is achieved in a hearing aid as referred to above in accordance with the present invention with a percentile estimator structure having at least a second control stage connected to the first control stage, and at least one additional integrator controlled by the second control stage, the output of which is connected to a further input of the second control stage as well as to a multiplier stage, interconnected between the first control stage and the first integrator.

It is of particular importance that the second control stage supplies a rectified and scaled version of the predefined parameters of the first control stage, generating a positive control signal for the second integrator and a forward reset signal to said second integrator for establishing a predefined minimum value of said integrator whenever the output signal of the first control stage changes.

Other characteristics of the invention and advantageous further embodiments thereof are subject of the remaining claims.

DETAILED DESCRIPTION OF A PREFERRED EMBODIMENT OF THE INVENTION

Figure 1:
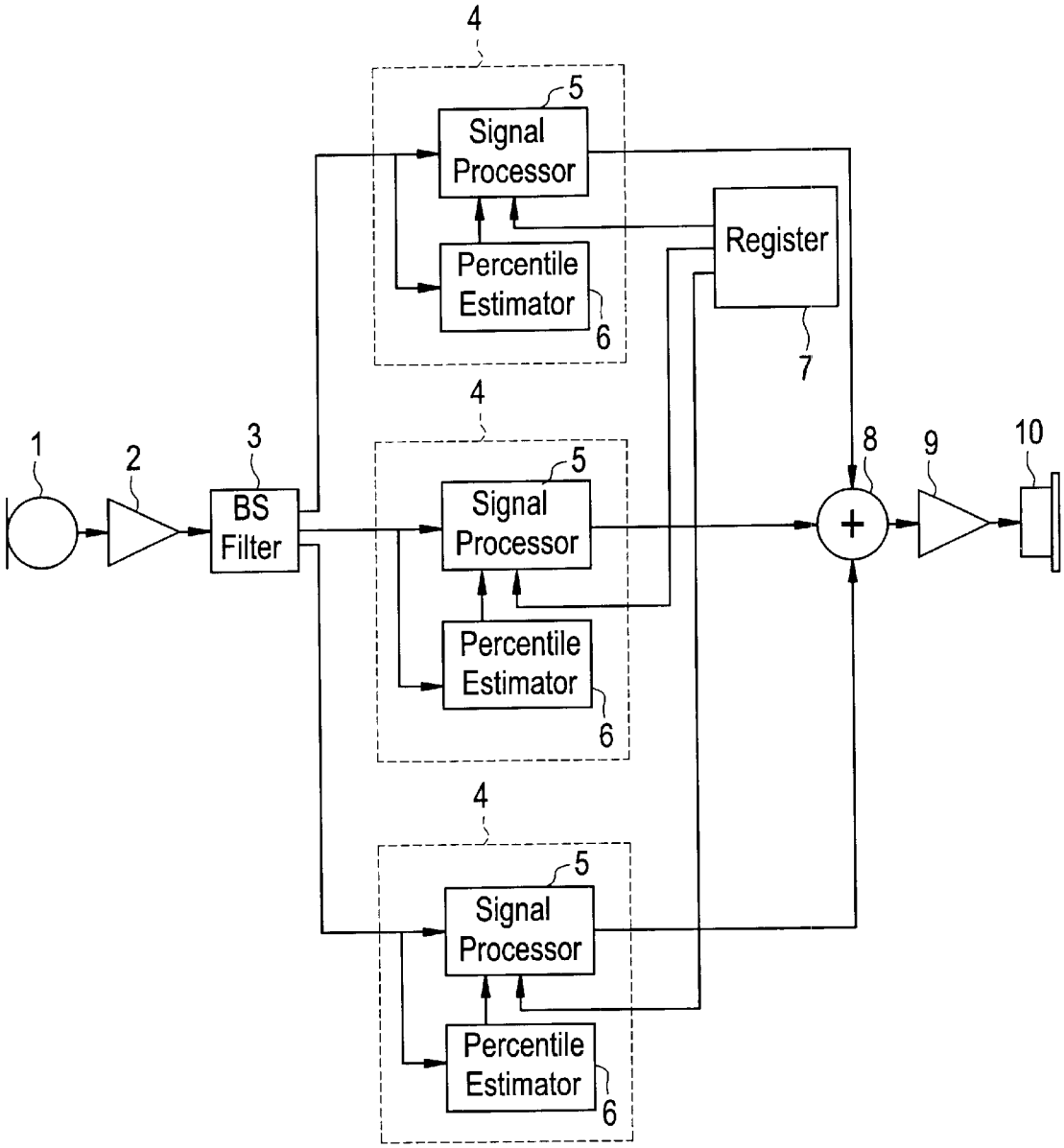
FIG. 1 PRIOR ART
FIG. 1 shows a schematic circuit diagram of a multichannel hearing aid using percentile estimators.

FIG. 1 shows a principle circuit diagram of a multichannel hearing aid with one microphone 1 and preamplifier 2, a band split filter 3 for splitting the signals into a number of channels (here 3 is shown), each having a signal processing circuit 4 consisting of a signal processor 5 and a percentile estimator 6, a register 7 for storing parameters related to the basic hearing aid performance, a summing circuit 8, an output amplifier 9 and a receiver 10.

Figure 2:
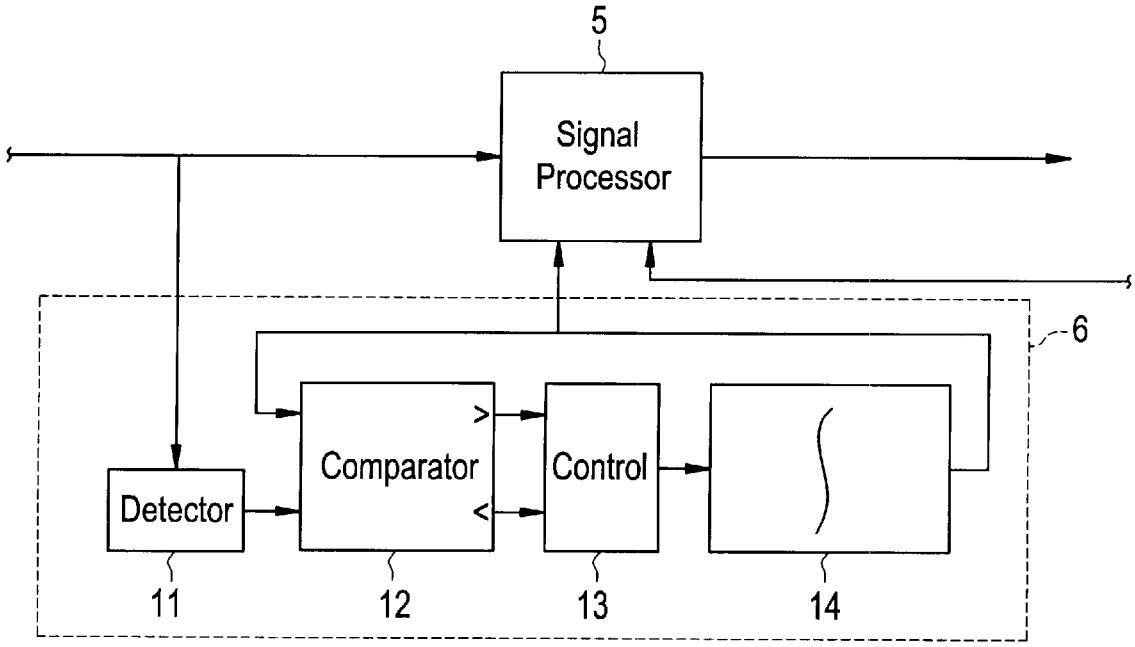
FIG. 2 PRIOR ART
FIG. 2 shows a schematic diagram of the principle of a percentile estimator.

FIG. 2 shows the principle of a traditional percentile estimator 6. Such percentile estimators are known from U.S. Pat. No. 4,204,260.

The input signal for the specific channel is led into a detector stage 11, which is not essential for the operation of the percentile estimator, but is preferably used. It could include a rectification for determining the envelope of the input signal, and also a logarithmic conversion to obtain the envelope on a dB-scale, which is commonly used in hearing aids. The output signal from the detector 11 is supplied to a comparator 12 with its two inputs connected to the output from the detector 11 and an integrator 14.

The result of the comparison is supplied to the control stage 13, which in case of the output of the integrator 14 being greater than the output of the detector 11 holds a predefined negative value at its output, causing a decrease of the value stored in the integrator 14, and in the opposite case holds a predefined positive value at its output, causing an increase of the integrator value.

In this way the value present at the output of the integrator 14 will be a percentile estimate of the input signal of the detector 11 and the signal processor 5, the percentile value being dependent on the actual predefined values of the control stage 13.

The output of the percentile estimator 6 is used for controlling the signal processor 5. Clearly, it is possible to include more than one percentile estimator 6 in each channel and let the signal processor be controlled by all of these in combination. In that case,a combination and control logic may be used to combine the output signals of the different percentile estimators.

Figure 3:
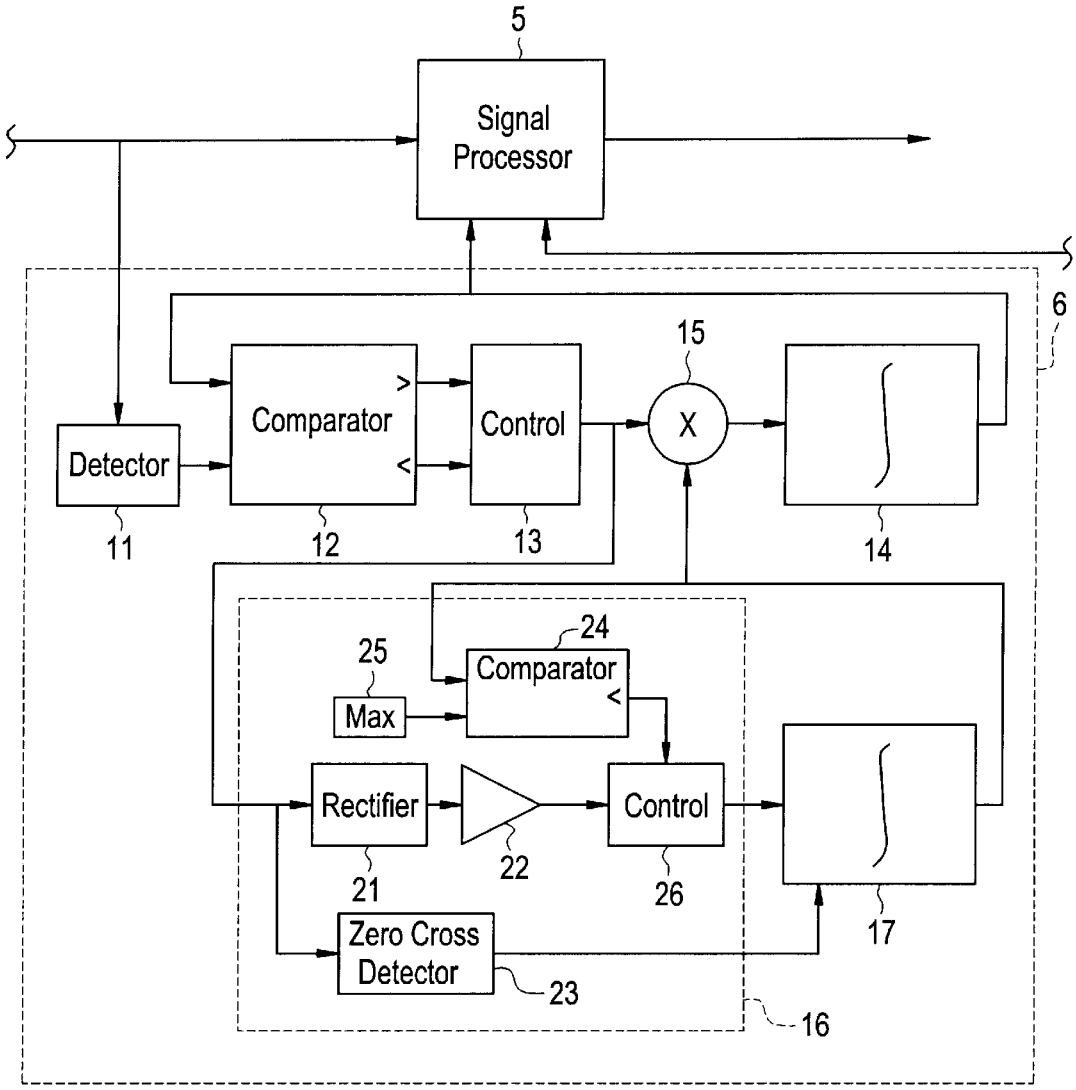
FIG. 3 shows,schematically, an improved percentile estimator for hearing aids with two levels in accordance with the present invention.

FIG. 3 shows the principle of an improved percentile estimator in accordance with the invention.

The traditional percentile estimator is modified with a multiplier 15, with its output supplying the integrator 14 and its inputs connected to the output of the control stage 13 and the output of an integrator 17. The integrator 17 is controlled by a control stage 16 which includes a rectifier 21 and a gain block 22 for rectifying and scaling the predefined parameters of the control stage 13 and thereby modifying the timing of the increase and decrease of the integrator 14 and thus the response time of the percentile estimator.

The control stage includes a zero-cross detector 23 which provides a reset pulse for the integrator, which then resets to a predefined minimum value whenever the output from the control stage 13 changes, hence whenever the input sound crosses the percentile estimator level.

The control stage 16 further may include a comparator 24 for checking if the output of the integrator 17 is less than a predefined maximum allowable value 25, in which case the transmission control 26 passes the output of the gain block 22 on to the integrator 17, and in the opposite case passes a value of zero or less on to the integrator 17 in order to prevent further increase of the integrator output.

The effect is an "accelerating" percentile estimator. The short term percentile estimator response time is long, dependent on the minimum value of the integrator 17 and will be dominant when the environment is characterized by a relatively constant sound level, where the input sound level crosses the percentile estimate frequently. The long term response time is relatively short because of the acceleration, and this effect will be of use in cases where the sound level changes, e.g. when communicating with a distant person, as mentioned earlier.

Figure 4:
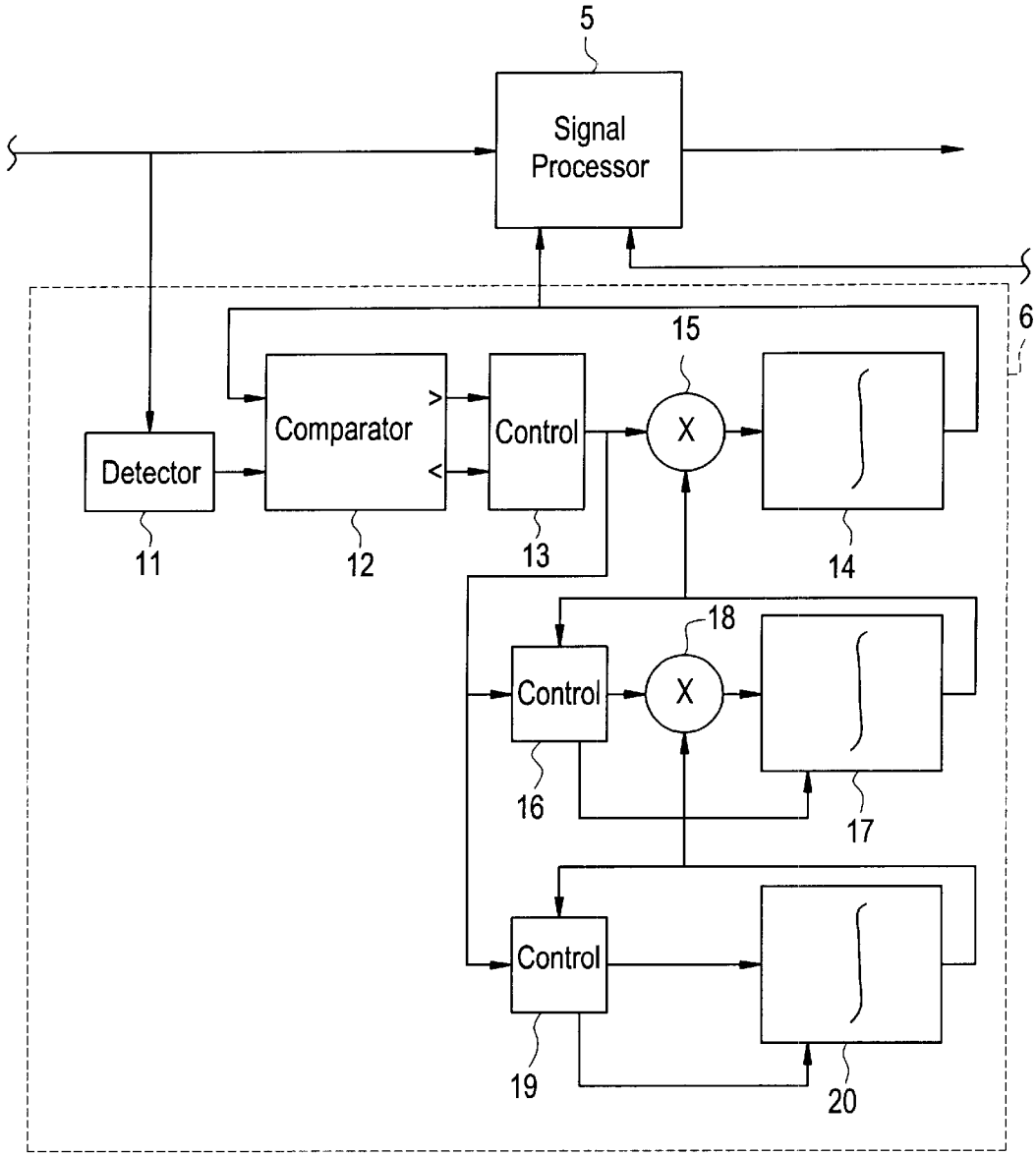
FIG. 4 shows, schematically, an improved percentile estimator for hearing aids with three levels in accordance with the invention

FIG. 4 shows an expansion of the improved percentile estimator by another level by adding a multiplier 18 with its output supplying the integrator 17 and its inputs connected to the output of the control stage 16 and the output of an integrator 20, which again is controlled by a control stage 19 similar to control stage 16.

Clearly it is possible to expand the number of levels in the improved percentile estimator even more than the three levels shown.

For the traditional percentile estimator of FIG. 2 a percentile level of p percent is obtained by the following formula:

$$p=100u/(u-d)$$

where u is the upward integration value (positive)

d is the downward integration value (negative)

Both u and d in the formula above are defined by the predefined values of the control stage 13.

In the improved percentile estimator, the integration speeds are time dependent. The upward integration speed is determined by $$u_{result} = u \cdot \int_0^{t_u} k_{16} \cdot |u| \cdot \int_0^{t_u} k_{19} \cdot |u| \, dt \ldots dt$$

and the downward integration speed is $$d_{result} = d \cdot \int_0^{t_d} k_{16} \cdot |d| \cdot \int_0^{t_d} k_{19} \cdot |d| \, dt \ldots dt$$

where $k_{16}$ and $k_{19}$ are the scaling factors in the control stages 16 and 19.

In a "stationary" sound environment, i.e. when the percentile estimate is stable, we have $$|u| \cdot t_u = |d| \cdot t_d = \text{constant}$$

where $t_u$ and $t_d$ are the collective time intervals over this stable time period in which the integrator integrates upwards and downwards, respectively.

This simplifies the integrations in the formulas above, and yields the following expressions for the integration speeds of the improved percentile estimator:

$$u_{result} = u \cdot k_{16} |u| \cdot k_{19} |u| \cdot t^u \ldots t_u$$

$$= u \cdot k_{16} \cdot k_{19} \ldots \text{constant}$$

$$d_{result} = d \cdot k_{16} \cdot |d| \cdot k_{19} \cdot |d| \cdot t_d \ldots t_d$$

$$= d \cdot k_{16} \cdot k_{19} \ldots \text{constant}$$

Hence, for stationary environments, even though the integration speeds are time dependent, the percentile level can be obtained by the same formula as for the traditional percentile estimator, since a constant multiplied to the integration speeds u and d does not change this formula.

Figure 5:
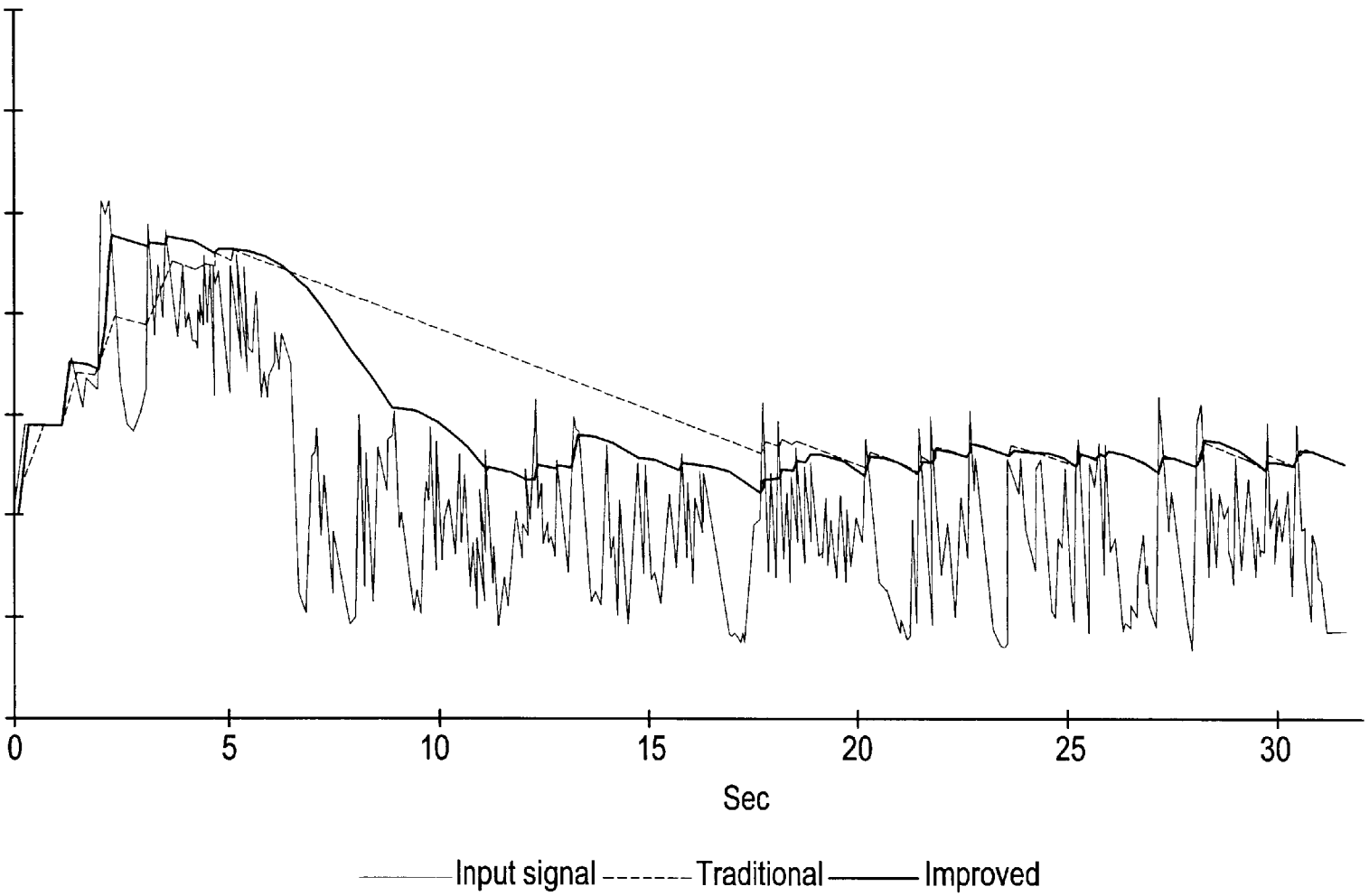
FIG. 5 shows a diagram of the operation of a traditional percentile estimator in comparison with the operation of the improved percentile estimator on an actual sound example.

FIG. 5 shows the function of a 2-level improved 90% percentile estimator with an increase from a minimum odB/sec growing 207.36 dB/sec$^2$ to a maximum of 57.6 dB/sec and a decrease from a minimum odB/sec growing 2,56 dB/sec$^2$ to a maximum of 6.4 dB/sec.

This is achieved by using a digital implementation with:

- a 32 kHz sampling frequency
- an upward integration step of u=5e−4 in the control stage 13
- a downward integration step of d=−5e−5 in the control stage 13
- a scaling factor of $k_{16}$=1 in the control stage 16
- a predefined minimum value of 0 of the integrator 17
- a predefined maximum allowable value of 4 of the integrator 17

The function is compared with a traditional 90% percentile estimator with an increase of 14.4 dB/sec and a decrease of 1.6 dB/sec.

The comparison is performed on an actual sound example with a duration of 32 secs. The sound level is stepped down 20 dB after approximately 7 secs to simulate a change of sound environment.

Note that the improved percentile estimator, because of the increasing integration speed,adapts much faster to change in environment than the traditional one, with respect to sound level increases (see the first 2 seconds) as well as sound level decreases (see the signal behaviour around 7 seconds).

Still, the improved percentile estimator behaves similar to the traditional one in the time range where the percentile estimation in both cases has become "stationary", i.e. from approximately 20 secs to 32 secs. This is due so the signal crossing the output of the improved percentile estimator, which generates a frequent reset of the integrator speed, and hereby keeps the response time of the percentile estimator long for this signal.

Finally, it may be pointed out that all the parameters of control stages 13 and the scaling factors of control stages 16 and 19 may be preset, may be programmable or may even be program controlled.

The steady progress in the design of very highly integrated circuits may lead to an extremely compact design of hearing aids, incorporating not only the improved percentile estimators for one or several channels but also the microprocessor and storage means for the necessary operational tools, such as algorithms.

Furthermore it is to be understood that the register 7 in FIG. 1 should comprise all necessary control parameters for the control of the transfer characteristic of the hearing aid, possibly also for various different programmed or programmable environmental listening situations.

What is claimed is:

1. A hearing aid having at least one microphone for providing an input signal, at least one signal processing channel receiving and processing at least a portion of said input signal to produce at least one output signal, an output amplifier for amplifying said at least one output signal, and an output transducer responsive to the amplified output signal, said at least one channel including a signal processing circuit for processing said input signal portion in accordance with a percentile estimator output signal, and a percentile estimator for providing said percentile estimator output signal, said percentile estimator comprising:

a comparator stage for comparing said input signal portion to said percentile estimator output signal;

a first control stage responsive to an output from said comparator stage for providing an integrator control signal representing a value and direction of integration;

a multiplier stage for modifying said value of the integrator control signal in accordance with a modification signal to produce a multiplier output signal;

a first integrator responsive to said multiplier output signal for providing said percentile estimator output signal; and a second control stage responsive to the integrator control signal of said first control stage for controlling a second integrator to provide said modification signal to the multiplier stage, wherein the second control stage contains a zero-cross-detector stage coupled to the input of said second control stage and adapted for providing a reset signal for resetting said second integrator to a predefined minimum value whenever the output of the first control stage changes.

2. The hearing aid in accordance with claim 1, wherein the output of the second integrator is fed to a second input of the second control stage.

3. The hearing aid in accordance with claim 1, wherein the second control stage supplies a rectified and scaled version of said integrator control signal to generate a positive control signal and a forward reset signal to said second integrator for establishing a predefined minimum value of said integrator whenever the output signal of the first control stage changes.

4. A hearing aid in accordance with claim 1, comprising a third control stage connected to the first control stage for controlling a third integrator, and a second multiplier connected between the second control stage and the second integrator and also with the input of the third integrator, the output of which is further connected to the third control stage for rectifying and scaling predetermined control parameters of the first control stage, generating a positive control signal for the third integrator and a forward reset signal to said third integrator for establishing a predefined minimum value of the third integrator whenever the sign of the output signal of the first control stage changes.

5. A hearing aid in accordance with claim 1, wherein the values of predefined parameters and predefined scaling factors of the control stages for the control of the integrators may be preset, programmed or program controlled.

6. A hearing aid in accordance with claim 1, wherein the values of the output signals of the control stages may be equal for the positive or negative changes to be effected in the integrators.

7. A hearing aid in accordance with claim 1, wherein a detector stage is connected between the input of the hearing aid and the input of the percentile estimator for mathematical processing of the input signal by way of predefined or predefinable algorithms or calculating rules, for the purpose of continuous determination of a signal sequence from the input signal.

8. A hearing aid in accordance with claim 7, a rectifier is connected between the input of the hearing aid and the input of the percentile estimator as a detector stage, for the purpose of the continuous determination of an envelope of the input signal.

9. A hearing aid having at least one microphone for providing an input signal, at least one signal processing channel receiving and processing at least a portion of said input signal to produce at least one output signal, an output amplifier for amplifying said at least one output signal, and an output transducer responsive to the amplified output signal, said at least one channel including a signal processing circuit for processing said input signal portion in accordance with a percentile estimator output signal, and a percentile estimator for providing said percentile estimator output signal, said percentile estimator comprising:

a comparator stage for comparing said input signal portion to said percentile estimator output signal;

a first control stage responsive to an output from said comparator stage for providing an integrator control signal representing a value and direction of integration;

a multiplier stage for modifying said value of the integrator control signal in accordance with a modification signal to produce a multiplier output signal;

a first integrator responsive to said multiplier output signal for providing said percentile estimator output signal; and a second control stage responsive to the integrator control signal of said first control stage for controlling a second integrator to provide said modification signal to the multiplier stage, wherein the second control stage comprises a second comparator stage, a rectifier stage, a gain block and a transmission control stage for rectifying and scaling the integrator control signal to output a second integrator control signal, said second comparator stage and said transmission control stage being adapted for keeping said second integrator control signal below a predefined maximum allowable value.

10. A hearing aid comprising a microphone for providing a microphone output signal, a signal processing circuit processing the microphone output signal in accordance with a processor control signal and providing a processor output signal, an output transducer, a percentile estimator processing the microphone output signal according to a scaling factor signal and providing the processor control signal and a parameter signal, and a scaling the scaling factor control stage processing the parameter signal to provide the scaling factor signal, wherein the scaling factor control stage includes a gain block for modifying and scaling the parameter signal.

11. The hearing aid according to claim 10, wherein the scaling factor control stage includes a scaling factor integrator.

12. The hearing aid according to claim 11, wherein the scaling factor control stage includes a zero-cross detector stage for resetting said scaling factor integrator to a predetermined minimum value whenever an output of the scaling factor control stage changes.

13. The hearing aid according to claim 10, wherein the scaling factor control stage includes means for keeping the scaling factor signal below a predetermined maximum value.

14. The hearing aid according to claim 10, wherein the percentile estimator includes a detector stage for determining the envelope of the microphone output signal and for performing a logarithmic conversion.

* * * * *

UNITED STATES PATENT AND TRADEMARK OFFICE

CERTIFICATE OF CORRECTION

PATENT NO. : 6,748,092 B1
DATED : June 8, 2004
INVENTOR(S) : Lars Baekgaard Jensen It is certified that error appears in the above-identified patent and that said Letters Patent is hereby corrected as shown below:

Title page,
Item [75], Inventor, should read -- Lars Baekgaard Jensen, Farum (DK) --

Signed and Sealed this

Seventh Day of September, 2004

JON W. DUDAS
*Director of the United States Patent and Trademark Office*